United States Patent [19]

Glickman

[11] 4,433,952

[45] Feb. 28, 1984

[54] TRACKED CRANE FOR LARGE OBJECTS

[75] Inventor: Myron Glickman, Morton Grove, Ill.

[73] Assignee: Mi-Jack Products, Inc., Hazel Crest, Ill.

[21] Appl. No.: 314,122

[22] Filed: Oct. 23, 1981

[51] Int. Cl.[3] ..... B66C 5/04

[52] U.S. Cl. ..... 414/460; 180/9.46; 212/208; 212/210; 212/218; 212/220; 294/81 R; 414/747

[58] Field of Search ..... 414/460, 461, 622, 745, 414/747; 212/208, 213, 218, 220, 221; 294/81 R, 81.62; 180/9.28, 9.3, 9.46

[56] References Cited

U.S. PATENT DOCUMENTS 2,871,052 1/1959 Neher ..... 294/81.62 X 3,408,950 11/1968 Puhringer ..... 105/177 X 4,029,165 6/1977 Miller et al. ..... 180/9.46 X 4,256,230 3/1981 Clark et al. ..... 414/460 X

*Primary Examiner*—Robert G. Sheridan

*Attorney, Agent, or Firm*—George H. Gerstman

[57] ABSTRACT

A tracked crane for hoisting and moving large objects in which the tracks are preferably pivotally mounted so that they may be elevated by jacks and horizontally pivoted into another direction. Following this, the crane can be driven in the other direction without turning. The crane may also have pivotally mounted pressure cylinder lifting means, and apparatus for pressing the top of the load carried by the crane to prevent bouncing of the load as the crane travels, and to hold it down during its installation as necessary.

2 Claims, 4 Drawing Figures

TRACKED CRANE FOR LARGE OBJECTS

BACKGROUND OF THE INVENTION

Figure 1:
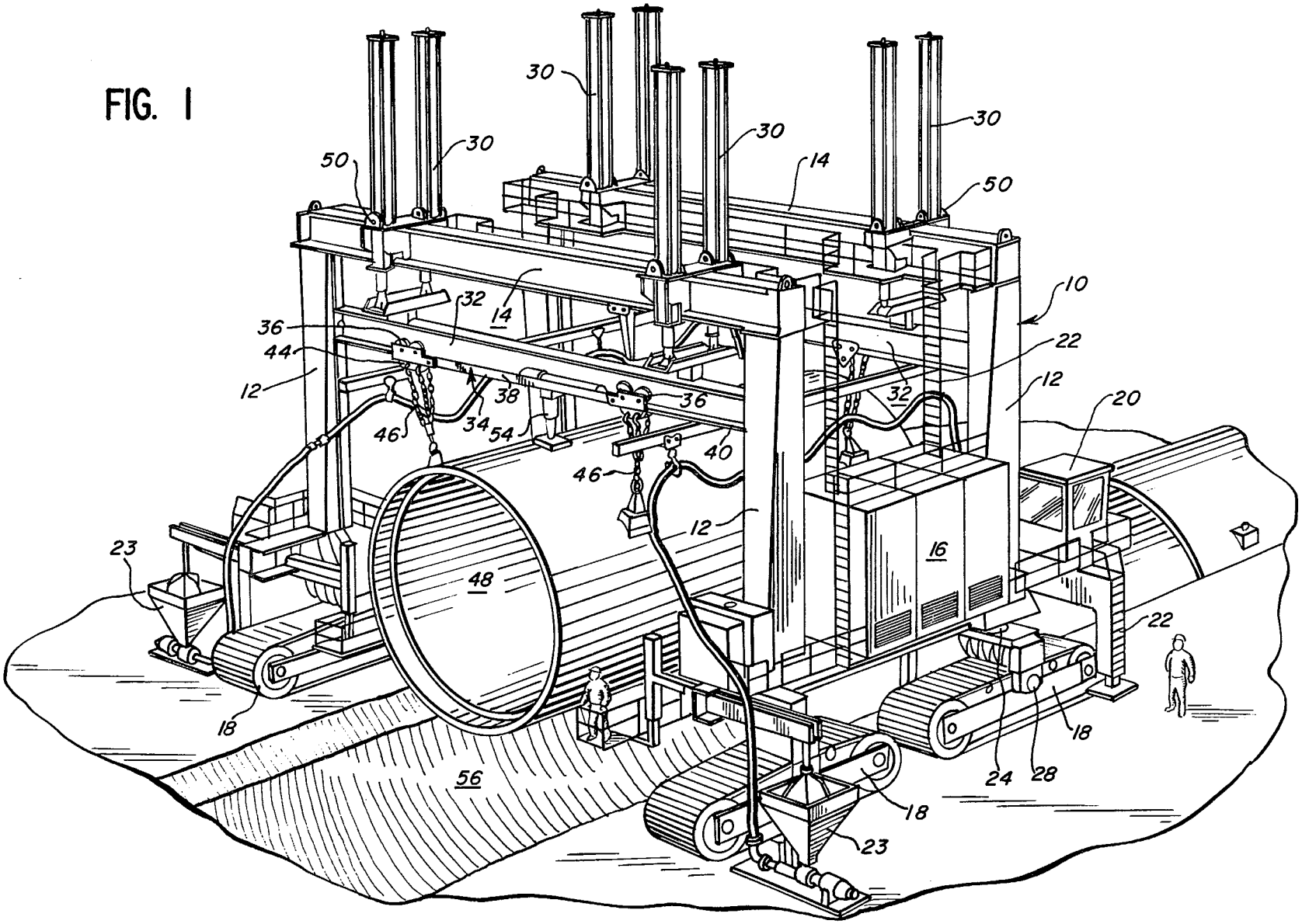
Figure 2A:
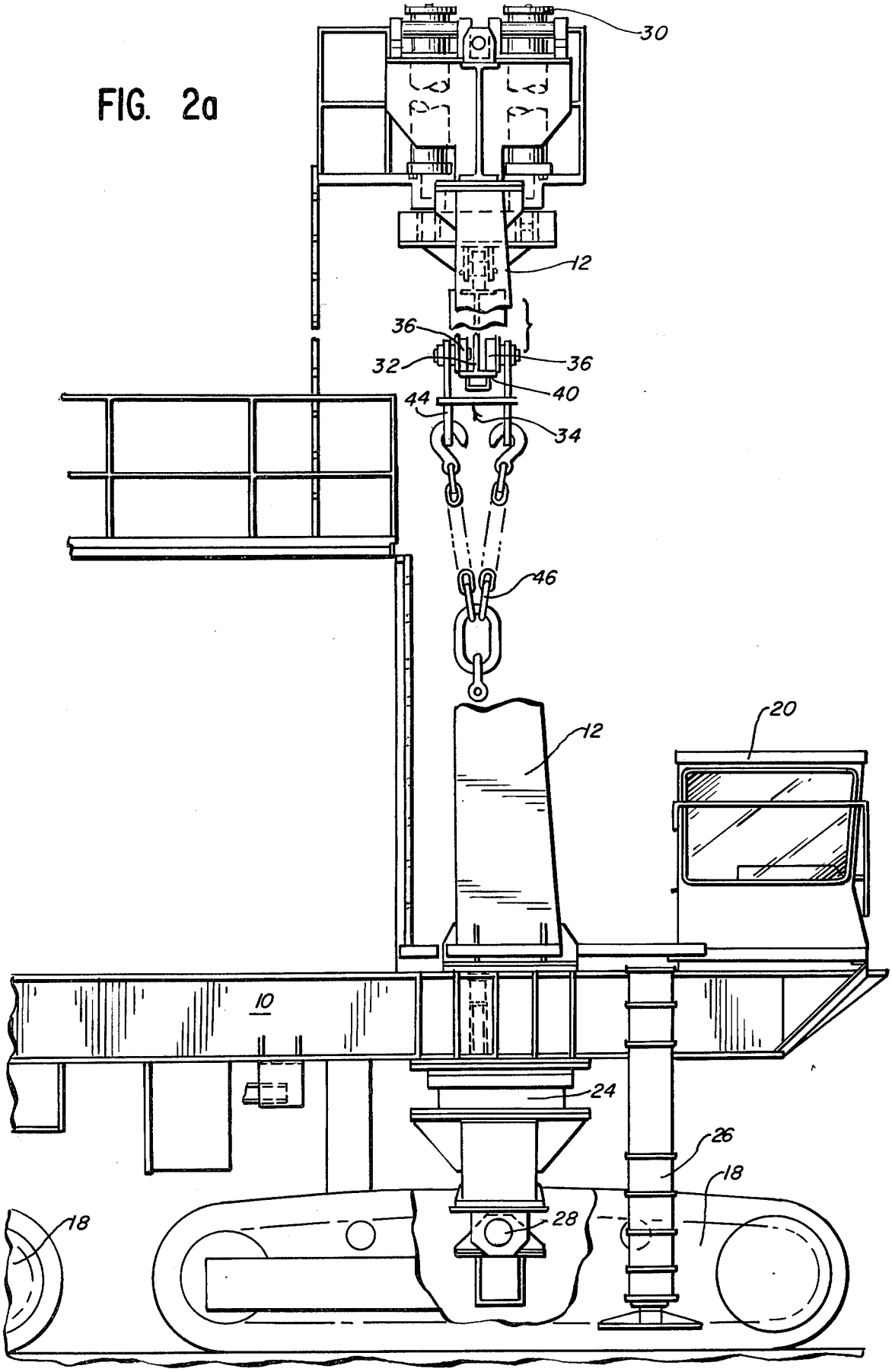
Figure 2B:
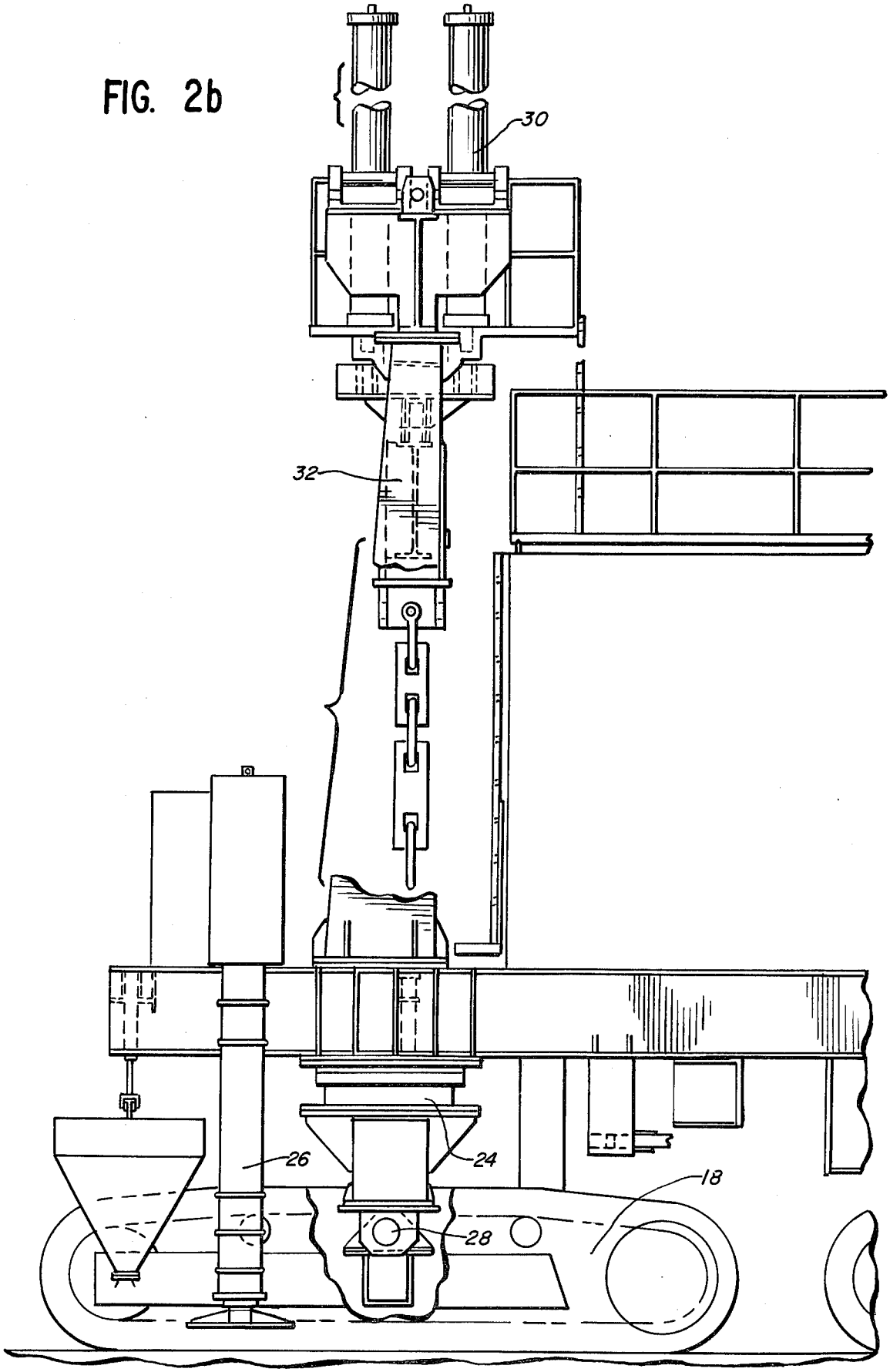

This application relates to a new type of crane for hoisting and moving ultra-large objects. For example, the crane may be used to carry tubular concrete segments or large pieces of pipe eighteen feet or more in diameter for transportation and assembly in the field. Missile silos may use large concrete housings of this type. In the alternative, large storage tanks or catch basins for water may be made from large, tubular segments of this type, where both the bulk and the weight of the object to be moved is extremely high, and at the same time the object must be carried over rough terrain.

DESCRIPTION OF THE INVENTION

In accordance with this invention a tracked crane is provided for hoisting and moving large objects. A frame includes side members and top support member means. Tracks are provided in each corner of the frame, plus means for driving the tracks to permit locomotion of the crane, with the driving means being a conventional motor and transmission. By this invention, the tracks are attached to the frame by means permitting horizontal pivoting. Jacks are also provided for elevating the frame and tracks off the ground. As the result of this, the tracks, when elevated, can be horizontally pivoted into another direction and then lowered to the ground again, to permit the crane to be driven in the other direction without turning. Thus the crane, which is generally very large, for example 52 feet long and about 48 feet high, still is very maneuverable.

Because of the feature of the horizontally rotatable tracks and the jacks, the crane can make a sharp 90° turn in its direction of motion simply by rotating the tracks by 90° to move sideways for a distance after having moved forward, for example, without the crane itself turning. However, if it is desired to turn the crane about its own axis, this can also be done by conventional use of the tracks, or by horizontally turning the front or the rear pairs of tracks and running them to cause the entire crane to turn.

The tracks also preferably have vertical pivot means to allow them to engage in pitching motion (i.e., vertical pivoting about the central axis of the track, as they travel across uneven terrain). This permits the crane to operate in roadless areas of a construction project.

In the crane of this invention, the top support member means typically comprises a pair of large horizontal beams. This top support member carries pressure cylinder lifting means, typically several hydraulic cylinders. The pressure cylinders of the lifting means carry vertically movable, generally horizontal stabilizing beam means, typically a pair of beams, one carried by each of the horizontal beams of the top support member.

The pressure cylinders are desirably pivotally mounted, and particularly with a double pivoting system, to the stabilizing beam to permit a degree of tilting of the stabilizing means during operation. Thus the various pressure cylinders attached to opposite ends of each stabilizing beam do not have to operate in absolute uniformity to raise and lower the stabilizing beam, since the beam is capable of at least a certain degree of tilting within the desired limits.

Trolley means, movable along the stabilizing beam means, may be provided. The trolley means is adapted for carrying chains and the like for connecting to and carrying the load.

It is also desirable for means to be provided for pressing against the top of the load carried by the crane. This means may be a hydraulic plunger with an enlarged pressure foot, to avoid damage to a breakable load such as large diameter concrete pipe, and serves to prevent bouncing of the load as the crane travels. Also, as the concrete pipe is installed into the ground and grout applied all over the pipe, the pressing means can serve to hold the hollow, large-diameter concrete pipe in position, counteracting a possible tendency of the pipe to float out of the grout which surrounds it, since the pipe is hollow and thus tends to be buoyant.

In the drawings, FIG. 1 is a perspective view of one embodiment of the crane of this invention shown to be carrying large diameter concrete pipe for installation into the ground as part of a tunnel or housing.

FIGS. *2a* and *2b* are elevational views of the front and rear ends of the crane of this invention, with parts broken away for clarity of view.

Figure 3:
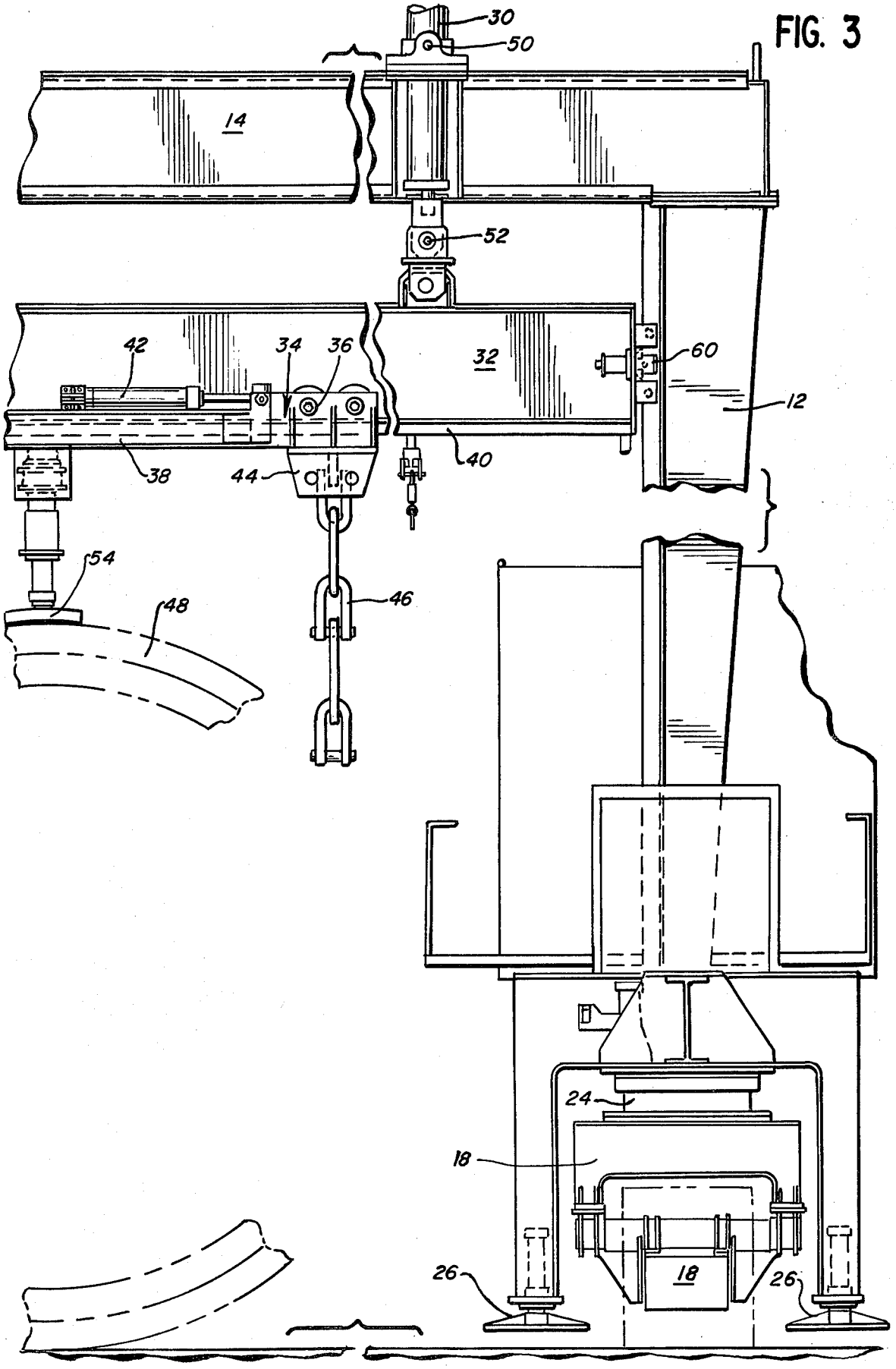

FIG. 3 is a fragmentary elevational view taken 90° from the views of FIGS. *2a* and *2b*.

Referring to the drawings, the crane in accordance with this invention defines a frame 10 including side members 12 which comprise large load carrying vertical beams, and top support member means which include a pair of horizontal beams 14. The crane carries a conventional diesel motor system 16 which may be connected to power each of the four tracks 18 positioned at each corner of the crane. Tracks 18, along with motor system 16 and its power transmission system may be broadly of a conventional design, except for the differences described herein. Control cab 20 is present as shown, along with appropriate ladders 22, catwalks, and the like to permit access all over the crane, which is typically of an extremely large size as shown.

Grout pumps 23 are also shown to cover and encase concrete pipe 48 with grout after it is installed.

Each of tracks 18 are attached to frame 10 by pivots 24, permitting horizontal rotation of the tracks. On each side of each track 18 a hydraulic jack 26 is mounted. Accordingly, while the crane can move forwardly and rearwardly in the normal manner of a tracked vehicle, it also has the capability of moving laterally in a "crab walk" manner. One can lift tracks 18 off of the ground by jacks 26, rotating tracks 18 by 90° or any angle desired, aligning them, lowering the jacks again, and operating the crane for sideward motion. See particularly FIG. 3, in which the tracks 18 are shown to be occupying a 90° angle from their configuration in the other drawings. Typically first one end of the crane and then the other is lifted to horizontally pivot the tracks 18.

Tracks 18 are also equipped with pivots 28 to permit the vertical pivoting of the tracks. This, in turn, allows them to pitch as they travel across uneven terrain, which puts less stress on the tracks as they support the huge weight of the crane, and provides greater facility of operation of the tracks.

The horizontal beams 14 which define the top support member means preferably carry hydraulic cylinders 30 as the pressure cylinder lifting means. The hydraulic cylinders 30, in turn, carry the generally horizontal stabilizing beam 32. A trolley 34 defines pairs of roller wheels 36 at opposed ends of a carriage 38 with wheels 36 being positioned on opposite sides of horizontal beam 32, resting upon the pair of lower horizontal flanges 40 of beam 32. Trolley 34 is adapted to move longitudinally along beam 32 by the action of hydraulic cylinder 42, which is attached to the trolley in the manner shown in FIG. 3. Trolley 34 is adapted with a conventional attaching members 44 for carrying large chains 46 or other carrying members for connecting to and carrying the load 48 such as the large concrete pipe as shown.

Hydraulic cylinders 30 are carried respectively by the top support beams 14, and are equipped with a pair of pivots 50, 52 to permit each stabilizer beam 32 to tilt slightly from the horizontal for simplifying the operation of the crane of this invention. The degree of tilting which can be tolerated is, of course, a function of the specific design of crane.

Additionally, a hydraulically operated presser foot 54 is provided, being carried by beam 32. Presser foot 54 may be vertically extensible and contractible by a conventional hydraulic system to press the load 48 downwardly. Accordingly, as the crane of this invention carries load 48 over rough terrain, the load is rigidly held, and thus does not bounce up and down as it might if held only by chains 46. Also, as previously described, tubular concrete sections as described can actually float out of the excavation 56 provided in the ground for them when fluid grouting material is applied over them, since they have a tendency to float on the grouting material until it has solidified. The pressure provided by hydraulic foot 54 can prevent this from happening.

Accordingly, in operation, the crane of this invention can drive over a concrete cylinder 48 to be moved. Connection can be made with chains 46 to horizontal stabilizing beam 32, and then hydraulic cylinders 30 can be activated to raise the concrete cylinder 48 in the manner shown. The crane can move over rough terrain either in sideways manner, forward, or backward, or even in a diagonal direction if desired, with the tracks 18 distributing the load to facilitate the use of this large crane on unprepared terrain. The tracks can pivot vertically to pitch up and over hillocks and small depressions in the ground without damage to the crane or its load, the tracks being steered by a conventional steering linkage which can turn all four tracks if desired. As stated, hold-down foot 54 prevents bouncing of the load during travel.

Upon arrival at the construction site as shown in FIG. 1, the crane can be placed into position as shown, with final adjustment of the positioning of tubular load 48 being provided by trolley 34 which permits lateral movement of the concrete tubular load 48 as little as a fraction of an inch in one horizontal transverse direction or the other. Following proper alignment, hydraulic cylinders 30 can be released to position the concrete load 48 in its prepared position 56. Beams 32 are raised and lowered by cylinders 30, being attached in rolling relation to side members 12 by rollers 60.

The above has been offered for illustrative purposes only, and is not intended to limit the scope of this invention, which is as defined in the claims below.

That which is claimed is:

1. A tracked crane for hoisting and moving large objects, which comprises: a frame including side members and top support member means, tracks adjacent each corner of the frame, means for driving said tracks to permit locomotion of the crane, said tracks being attached to the frame by horizontal pivot means, and jack means for elevating said frame and tracks off of the ground, whereby said tracks, when elevated, can be horizontally pivoted into another direction and then lowered to the ground again, to permit said crane to be driven in another direction without turning; said tracks also have vertical pivot means to allow them to pitch as they travel across uneven terrain; said top support member means carries pressure cylinder lifting means, the pressure cylinders of said lifting means carrying vertically movable, generally horizontal stabilizing beam means; trolley means, movable along said stabilizing beam means is provided, said trolley means being adapted for carrying flexible members for connecting to and carrying a load; and means are provided for pressing on the top of the load carried by said crane to prevent bouncing of the load supported by said flexible member, as the crane travels and to hold the load down during its installation as necessary.

2. The tracked crane of claim 1 in which said pressure cylinders are pivotally mounted to said stabilizing beam means to permit a degree of tilting of said stabilizing beam means.

* * * * *